United States Patent [19]

Di Stefano

[11] Patent Number: 4,861,176

[45] Date of Patent: Aug. 29, 1989

[54] CARTRIDGE INCLUDING EPICYCLIC GEARING DRIVE FOR A MULTISTRIKE TYPING RIBBON FOR PRINTING MACHINES

[75] Inventor: Giorgio Di Stefano, Turin, Italy

[73] Assignee: Ing. C. Olivetti & C., S.p.A., Ivrea, Italy

[21] Appl. No.: 211,290

[22] Filed: Jun. 24, 1988

[30] Foreign Application Priority Data

Jul. 2, 1987 [IT] Italy ..... 67567 A/87

[51] Int. Cl.[4] ..... B41J 32/00

[52] U.S. Cl. ..... 400/208; 400/236.2

[58] Field of Search ..... 400/194, 195, 196, 196.1, 400/207, 208, 208.1, 212, 221, 221.1, 221.2, 223, 228, 229, 236.2, 240.3; 74/354

[56] References Cited

U.S. PATENT DOCUMENTS

| | | | |
|---|---|---|---|
| 2,340,803 | 2/1944 | Fitch et al. | 400/221 X |
| 4,010,839 | 3/1977 | Guerrini et al. | 400/207 X |
| 4,623,273 | 11/1986 | Gubau | 400/208 |
| 4,669,902 | 6/1987 | Ukmar et al. | 400/208 |
| 4,712,931 | 12/1987 | Ohshima | 400/212 X |
| 4,762,434 | 8/1988 | Hirano | 74/354 X |

FOREIGN PATENT DOCUMENTS

| | | | |
|---|---|---|---|
| 2354170 | 5/1975 | Fed. Rep. of Germany | 400/221 |
| 0167488 | 12/1981 | Japan | 400/221 |
| 0078791 | 5/1983 | Japan | 400/208 |
| 0158285 | 9/1983 | Japan | 400/236.2 |
| 0191182 | 11/1983 | Japan | 400/196.1 |
| 0227480 | 12/1984 | Japan | 400/236.2 |
| 0250979 | 12/1985 | Japan | 400/208 |
| 0080085 | 4/1987 | Japan | 400/229 |

OTHER PUBLICATIONS

IBM Technical Disclosure Bulletin, "Clutched Planetary Ball Drive System for Inked Ribbons", Hart, vol. 19, No. 12, May 1977, pp. 4713–4716.

IBM Technical Disclosure Bulletin, "Page Width Ribbon Cartridge and Drive Mechanism", Thorne, vol. 25, No. 4, Sep. 1982, pp. 2020–2022.

IBM Technical Disclosure Bulletin, "Tension Servoed, Variable Torque, Center Driven Ribbon Control Transmission", vol. 31, No. 5, Oct. 1988, pp. 102–103.

*Primary Examiner*—Ernest T. Wright, Jr.

*Attorney, Agent, or Firm*—Banner, Birch, McKie & Beckett

[57] ABSTRACT

A cartridge for a multistrike typing ribbon for printing machines engages a single drive shaft for unidirectional advance movement of the multristrike ribbon and comprises a container having a bottom and two arms which project from a rear wall and which each have an aperture for the ribbon to pass therethrough. An epicyclic transmission arrangement is disposed on the bottom and comprises a series of toothed gears which are coplanar with each other and parallel to the bottom. The drive shaft is engaged with a feed sleeve of the cartridge and is coaxial with the feed roller for the ribbon. The feed sleeve is fixed with respect to the sun gear of the arrangement, the sun gear being engaged with the planet gear which in turn is rotatable on an eccentric pin of a plate. The plate is fixed with respect to a second sleeve which is rotatable about the sleeve and on which the feed roller is fixed. The gear is always engaged with an internally toothed ring which is provided on the bottom and constitutes the fixed annulus gear of the arrangement. The transmission ratio as between the gears is such as substantially to reduce the number of turns of the feed roller with respect to the turns of the drive shaft.

12 Claims, 2 Drawing Sheets

CARTRIDGE INCLUDING EPICYCLIC GEARING DRIVE FOR A MULTISTRIKE TYPING RIBBON FOR PRINTING MACHINES

BACKGROUND OF THE INVENTION

The present invention relates to a cartridge for a multistrike typing ribbon for printing machines comprising a single drive shaft for unidirectional feed of the ribbon by rotation of a feed roller and in which the cartridge comprises a container having a bottom and two arms projecting from a rear wall and each having an aperture for the multistrike ribbon to pass therethrough. Printing machines are knowwn which alternatively use cartridges with a carbon ribbon, a fabric ribbon or a multistrike ribbon. The feed movement of the ribbon occurs incrementally by means of a roller of the cartridge and varies in accordance with the type of ribbon used and in particular in cartridges with a fabric or carbon ribbon, the ribbon feed is greater than that provided for a multistrike ribbon. Some machines provide a drive shaft with constant incremental rotary movements for each type of cartridge. Cartridges with a multistrike ribbon, which can be mounted on such machines, provide trains of double gears which reduce the speed of rotation of the feed roller of the cartridge with respect to that of the drive shaft. Such a construction is expensive and bulky.

SUMMARY OF THE INVENTION

The object of the present invention is therefore to provide a cartridge for a multistrike ribbon which can be used alternatively with a cartridge for a carbon ribbon, the overall dimensions of which are reduced and which at the same time is simple, reliable and inexpensive.

The object is met by the cartridge according to the present invention, which is characterised by a gear transmission arrangement which is disposed on the container bottom and comprises a series of gears which are coplanar with each other and parallel to the bottom and by a drive element of the transmission arrangement which is coaxial with the multistrike ribbon feed roller and is engageable with the single driver shaft, and a driven element of the transmission arrangement for rotating the feed roller.

BRIEF DESCRIPTION OF THE DRAWING

A preferred embodiment of the present invention is set forth in the following description which is given by way of non-limiting example and with reference to the accompanying drawing in which.

DESCRIPTION OF THE PREFERRED EMBODIMENT

Figure 1:
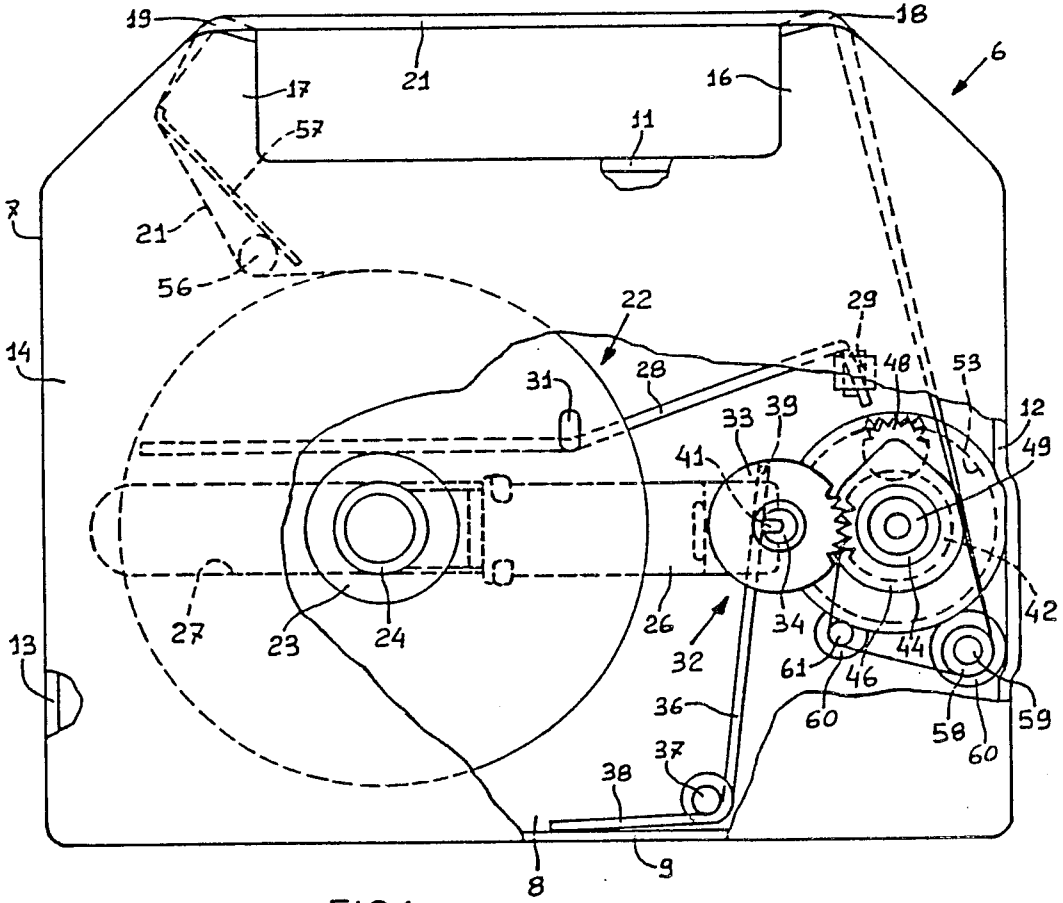
FIG. 1 is a plan view of part of the cartridge according to the invention.

Referring to FIG. 1, the removable cartridge for a typing ribbon which is indicated at reference numeral 6 is substantially similar to the cartridge described in the U.S. Pat. No. 4,623,273 assigned to the same assignee of the present application, and therefore is described herein only in order more clearly to show and illustrate the invention. The cartridge 6 comprises a container 7 having a bottom 8, a front wall 9, a rear wall 11, two side walls 12 and 13 and a cover 14 which closes the container 7 upwardly. The cartridge 6 has two arms 16 and 17 which project from the rear wall 11 and which each have an aperture 18 and 19 respectively for permitting a multistrike typing ribbon 21 to pass therethrough. The cartridge 6 comprises a supply spool which is generally indicated at 22 and on which the multistrike ribbon 21 is wound. The supply spool 22 comprises a tube 23 which is rotatable about a sleeve 24 projecting from a slider 26 which in turn is housed and slidable in a guide 27 in the bottom 8. A wire spring 28 is supported at one end in a support 29 and braced by a support 31 which both project from the bottom 8 and is capable of co-operating with the lower part of the tube 23 to exercise a friction effect on the supply spool 22.

The cartridge 6 comprises a take-up spool which is generally indicated at 32, on which the multistrike ribbon 21 is wound after it has been used at the point of typing between the arms 16 and 17. The take-up spool 32 is formed by a tube 33 which is rotatable about a sleeve 34 projecting from the slider 26. A wire spring 36 which is carried on a peg 37 projecting from the bottom 8 has one end 38 engaged against the front wall 9 and the other end 39 engaged against a peg 41 on the slider 26 for normally urging the slider 26 towards the right-hand side wall 12, that is to say it ensures that the take-up spool 32 presses the outside surface of the multistrike ribbon 21 against a series of needle teeth of a feed roller 42 which is fixed with respect to a drive assembly generally indicated at 43 (see FIG. 2).

A transmission arrangement which is generally identified by reference numeral 40 comprises the drive assembly 43 which is formed by a sleeve 44 fixed with respect to an eccentric plate 46 which in turn has a pin 47 on which an intermediate gear 48 having twenty two teeth is rotatable. A feed sleeve 49 is rotatable between the bottom 8 and the cover 14 within the sleeve 44 and is driven in rotation by a drive shaft 51 of the machine, which is substantially similar to that described in U.S. Pat. No. 4,010,839 assigned to the same assignee of the present application, when the cartridge 6 is mounted on the machine. The feed sleeve 49 is in one piece with a gear 52 which is always engaged with the intermediate gear 48. The gear 48 is always engaged with a toothed ring 53 having fifty six internal teeth, provided in a recess in the bottom 8 in which the gear 52 and the gear 48 are also disposed. A disc 54 which projects from the cover 14 is fixed on the sleeve 49 for manual feed of the multistrike ribbon 21. The transmission arrangement 40 is thus of epicyclic type in which the gear 52 constitutes the sun gear, the gear 48 is a planet gear and the gear 53 is the annulus gear.

As the multistrike ribbon 21 (see FIG. 1) is unwound from the supply spool 22, it bears against a fixed peg 56 and the end of a leaf spring 57, passes through the aperture 19 and moves into the typing zone. From there it goes back into the container 7 by way of the aperture 18 and bears against a roller 58 which is rotatable on a fixed pin 59, and against a fixed pin 61, and is wound on to the take-up spool 32. The two pins 59 and 61 have a shoulder 60 against which the lower edge of the ribbon 21 bears.

The feed roller 42, by virtue of the action of the wire spring 36 against the slider 26, engages by means of its teeth against the outermost turns of the multistrike ribbon 21 which is wound on the take-up spool 32. Rotary movement of the feed roller 42 causes rotation of the take-u spool 32 and causes the multistrike ribbon 21 to be wound on the tube 33, as described in above-mentioned U.S. Pat. No. 4,623,273. The cartridge 6 is mounted removably on a printing machine on which cartridges with a carbon ribbon or cartridges with a fabric ribbon can also be alternatively mounted. After the operation of printing a character on the part of the printing machine, the drive shaft 51 (see FIG. 2) is always caused to rotate by constant amounts which are matched to optimum use of cartridges for a carbon ribbon and cartridges for a fabric ribbon, in which the feed movement of the ribbon is effected by a feed roller which is synchronous with the shaft 51.

Since the multistrike ribbon 21 permits more characters to be struck on the same piece of ribbon, the transmission ratio of the transmission arrangement 40 between the gear 52, the intermediate gear 48 and the toothed ring 53 is such that the number of turns of the feed roller 42 is substantially reduced with respect to the number of turns of the drive shaft 51. In particular the drive shaft 51 rotates with the feed sleeve 49 which by means of the 'sun' gear 52 rotates the intermediate 'planet' gear 48. The intermediate gear 48 always being engaged with the fixed annulus gear 53 of the arrangement 40, it causes rotary movement of the eccentric plate 46 with the sleeve 44 and the feed roller 42. The speed reduction ratio is 3.54:1 which is obtained as a result of the ratio between the number of internal teeth of the fixed annulus 53 and the number of teeth of the sun gear 52, plus one. The drive shaft 51 performs 3.54 revolutions while the feed roller 42 performs one single revolution in the same direction, and thus the multistrike ribbon 21 is advanced by an amount which is much less than that of a carbon ribbon and a fabric ribbon.

Figure 2:
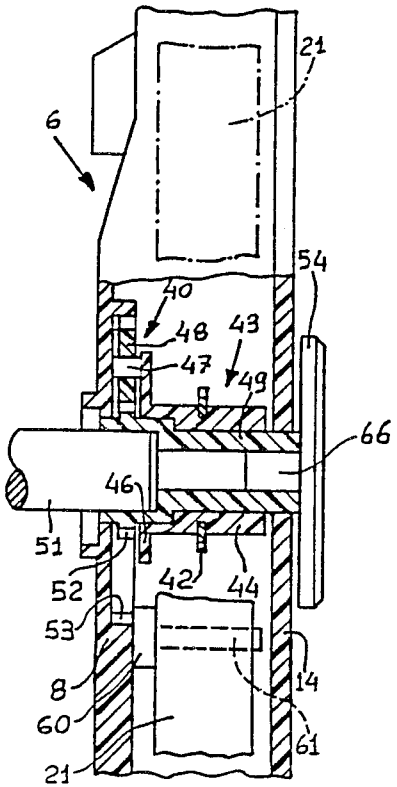
FIG. 2 is a sectional side view of part of the cartridge of FIG. 1 on an enlarged scale.

The toothed ring 53, the gear 52 and the intermediate gear 48 are coplanar with each other and parallel to the bottom 8 of the cartridge 6, as can be clearly seen from FIG. 2, so that those gear arrangements do not interfere with the multistrike ribbon 21 which is wound on the take-up spool 32 and, occupying a small amount of space at the bottom 8, they permit the cartridge 6 to be of small and compact dimensions.

An operator can rewind manually the multistrike ribbon 21, for instance for tensioning it when the cartridge 6 will be mounted on a printing machine. To this end, the manual rotation of the disc 54 causes rotation of the feed sleeve 49 directly through a pin 66 and the feed roller 42 indirectly through the transmission arrangement 40 and the drive assembly 43, for the advancing of the ribbon 21. The quantity of ribbon 21 fed for an angular increment of the disc 54 is indentical to that of an identical angular increment of the drive shaft 51 as above described, but such a quantity is less than the quantity obtainable from an identical angular increment of the roller 42.

Figure 3:
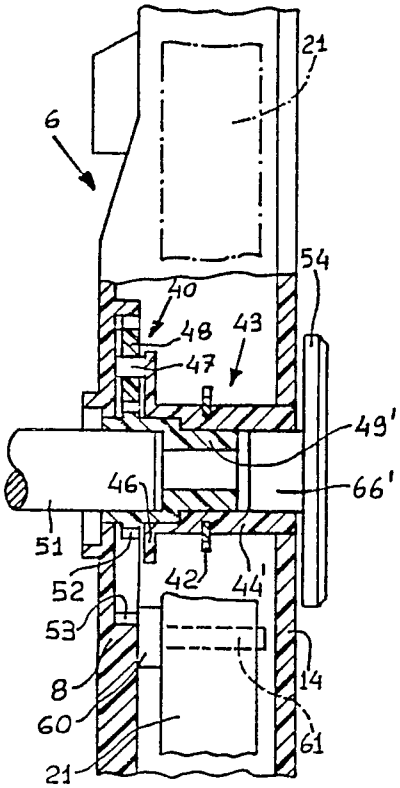
FIG. 3 is a sectional side view of a modification of the cartridge of FIG. 1 on an enlarged scale.

In the modification of FIG. 3 the feed roller 42 is fixed on a sleeve, identified by reference numeral 44', which is rotatable supported by the cover 14. The advancing sleeve, reference numeral 49' has an height less than that of sleeve 49 of FIG. 2 and it is connected with the sole drive shaft 51. The disc 54 is angularly fixed with the sleeve 44' by means of a pin 66' and not with the sleeve 49'. If the operator rotates the disc 54, the sleeve 44' and the feed roller 42 are also directly rotated. Therefore for a manual rewinding, the multistrike ribbon 21 of the cartridge of FIG. 3 will be advanced more quickly than in the cartridge of FIG. 2 and the transmission device 40 of FIG. 3 will be not rotated by the disc 54 but by the sole drive shaft 51.

It will be appreciated that the cartridge 6 for a multistrike ribbon 21 may be the subject of various modifications and improvements both in regard to the shape and the arrangement of the various elements and parts without thereby departing from the scope of the present invention. For example the annulus gear of the arrangement 40 could be rotatable and support the roller 42 and the gear 48 could rotate about a pin which is fixed to the bottom, for a transmission ratio which is lower than that indicated and with reversal of the direction of rotation of the roller 42.

What I claim is:

1. A cartridge for a multistrike typing ribbon for printing machines comprising a single drive shaft for unidirectional feed of the typing ribbon and in which the cartridge comprises a containeer for a multistrike typing ribbin having a bottom and a cover, a multistrike ribbon feed roller rotatably supported in said container for feeding said typing ribbon, and the combination comprising:

a gear transmission arrangement which is disposed on said bottom away from the internal trajectory of the typing ribbon and comprises a drive element to be rotated by the drive shaft of the machine, a driven element for rotating said multistrike ribbon feed roller and a series of gears interconnecting said drive element with said driven element;

wherein said series of gears are coplanar each other and parallel to said bottom, and wherein said drive element is coaxial with said multistrike ribbon feed roller and is engageable with said single drive shaft.

2. A cartridge according to claim 1, wherein the drive element comprises a feed sleeve which is rotatable between the bottom and the cover of the container and carrying a first one of the gears and wherein said feed roller is fixed on a second sleeve which is coaxial with the feed sleeve and forms the driven element, the second sleeve being fixed with respect to a plate having a pin or which another of the gears is rotatable.

3. A cartridge according to claim 2, wherein the transmission arrangement comprises a toothed ring provided in the bottom of the container and wherein the gear on the pin is always engaged with the gear of the feed sleeve and with the toothed ring.

4. A cartridge according to claim 3, wherein the transmission arrangement has a transmission ratio between the feed sleeve gear, the gear on the pin and the toothed ring such as substantially to reduce the revolutions of the feed roller with respect to those of the drive shaft.

5. A cartridge according to claim 2, further comprising a knob member rotatably supported by said container and manually accessible externally to said container and a connecting member interconnecting said knob member with said second sleeve for direct manual rotating of said feed roller.

6. A cartridge according to claim 2, further comprising a knob member rotatably supported by said container and manually accessible externally to said container and a connecting member for interconnecting said knob member with said feed sleeve in order to cause the revolutions of said feed roller to be substantially reduced with respect to those of said knob member.

7. A cartridge according to claim 1, in which the container further comprises two arms projecting from a rear wall and each having an aperture for the multistrike typing ribbon to pass therethrough, in which a feed spool and a take-up spool are rotatable in the container, in which the multistrike ribbon is unwound from the feed spool, passes through the apertures in the two arms and is wound on the take-up spool, and in which the multistrike ribbon is wound on to the take-up spool by the rotary movement of the feed roller without interfering with the gear transmission arrangement.

8. A cartridge for a multistrike typing ribbon for printing machines comprising a drive shaft for unidirectional feed of the ribbon and in which the cartridge comprises a container having a bottom, a coupling member rotatable on the container and capable of being coupled to the drive shaft to be rotated incrementally by the drive shaft, a feed roller capable of being coupled to the ribbon for the feed of the ribbon and a speed reducing mechanism for reducing speed between the coupling member and the roller, wherein said speed reducing mechanism comprises an epicyclic transmission arrangement having a series of gears defining a sun gear, planet gear and an annulus gear, wherein said gears are coplanar with each other and wherein said sun gear rotates with said coupling member.

9. A cartridge according to claim 8, wherein the planet gear of the epicyclic transmission arrangement is carried by a support which rotates with the feed roller and the annulus gear is fixed on the bottom of the container.

10. A cartridge according to claim 9, wherein the annulus gear has internal teeth provided in a recess in the bottom, in which the planet gear and the sun gear are also disposed in said recess, and in which said support is formed by a plate which is paralel to said bottom and does not interfere with said multistrike typing ribbon.

11. A cartridge according to claim 9, further comprising a knob member rotatably supported by said container and manually accessible externally to said container and a connecting member interconnecting said knob member with said feed roller for direct manual rotating of said feed roller.

12. A cartridge according to claim 9, further comprising a knob member rotatably supported by said container and manually accessible externally to said container and a connecting member for interconnecting said knob member with said sun gear in order to cause the revolutions of said feed roller to be substantially reduced with respect to those of said knob member.

* * * * *